US009310730B2

(12) United States Patent
Takahashi et al.

(10) Patent No.: US 9,310,730 B2
(45) Date of Patent: Apr. 12, 2016

(54) FIXING DEVICE AND IMAGE FORMING APPARATUS

(71) Applicant: KYOCERA Document Solutions Inc., Osaka (JP)

(72) Inventors: Hironori Takahashi, Osaka (JP); Motoki Moriguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/677,196

(22) Filed: Apr. 2, 2015

(65) Prior Publication Data

US 2015/0293481 A1 Oct. 15, 2015

(30) Foreign Application Priority Data

Apr. 15, 2014 (JP) ..... 2014-083314

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 2215/2035
See application file for complete search history.

(56) References Cited

U.S. PATENT DOCUMENTS 8,953,994 B2 2/2015 Iwaya et al.
2012/0163882 A1* 6/2012 Kim ..... G03G 15/2025 399/328

FOREIGN PATENT DOCUMENTS

JP 2013-145288 A 7/2013

* cited by examiner

*Primary Examiner* — Gregory H Curran
(74) *Attorney, Agent, or Firm* — Studebaker & Brackett PC

(57) ABSTRACT

A fixing device includes a fixing belt, a pressuring member, a heat source and a nip member. The fixing belt is arranged rotatably. The pressuring member is arranged rotatably to come into pressure contact with the fixing belt so as to form a fixing nip. The heat source is arranged at the inside in a radial direction of the fixing belt to radiate a radiant heat. The nip member is arranged so as to sandwich the fixing belt between the nip member and the pressuring member. The heat source, the fixing belt and the nip member are arranged so that the radiant heat radiated from the heat source reaches directly an inner circumference face of the fixing belt and the nip member.

10 Claims, 8 Drawing Sheets

FIXING DEVICE AND IMAGE FORMING APPARATUS

INCORPORATION BY REFERENCE

This application is based on and claims the benefit of priority from Japanese Patent application No. 2014-083314 filed on Apr. 15, 2014, the entire contents of which are incorporated herein by reference.

BACKGROUND

The present disclosure relates to a fixing device fixing a toner image onto a recording medium and an image forming apparatus including the fixing device.

Conventionally, an electrographic image forming apparatus, such as a copying machine, a printer, a facsimile or a multifunction peripheral, includes a fixing device fixing a toner image onto a recording medium, such as a sheet. In the fixing device, a heating roller manner is widely used. The heating roller manner is a manner forming a fixing nip by using a pair of rollers.

However, in order to reduce heat capacity of the fixing device and to shorten warm-up time, transition of a fixing manner from the above-mentioned heating roller manner to a belt manner is progressed. The belt manner is a manner forming the fixing nip by using a fixing belt.

For example, there is the fixing device including the fixing belt, a pressuring member coming into pressure contact with the fixing belt to form the fixing nip, a heat source arranged at the inside in a radial direction of the fixing belt, a nip member arranged so as to sandwich the fixing belt between the nip member and the pressuring member and a supporting member supporting the nip member.

In the fixing device with such a configuration, when the supporting member is arranged between the heat source and the nip member, it is impossible to radiate a radiant heat from the heat source directly to the nip member and it becomes difficult to heat the fixing nip by heat transmission from the nip member. Therefore, when the recording medium takes heat of the fixing nip while the recording medium passes through the fixing nip, it is feared that temperature of the fixing nip is suddenly lowered and the toner image cannot be surely fixed onto the recording medium.

SUMMARY

In accordance with an embodiment of the present disclosure, a fixing device includes a fixing belt, a pressuring member, a heat source and a nip member. The fixing belt is arranged rotatably. The pressuring member is arranged rotatably to come into pressure contact with the fixing belt so as to form a fixing nip. The heat source is arranged at the inside in a radial direction of the fixing belt to radiate a radiant heat. The nip member is arranged so as to sandwich the fixing belt between the nip member and the pressuring member. The heat source, the fixing belt and the nip member are arranged so that the radiant heat radiated from the heat source reaches directly an inner circumference face of the fixing belt and the nip member.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
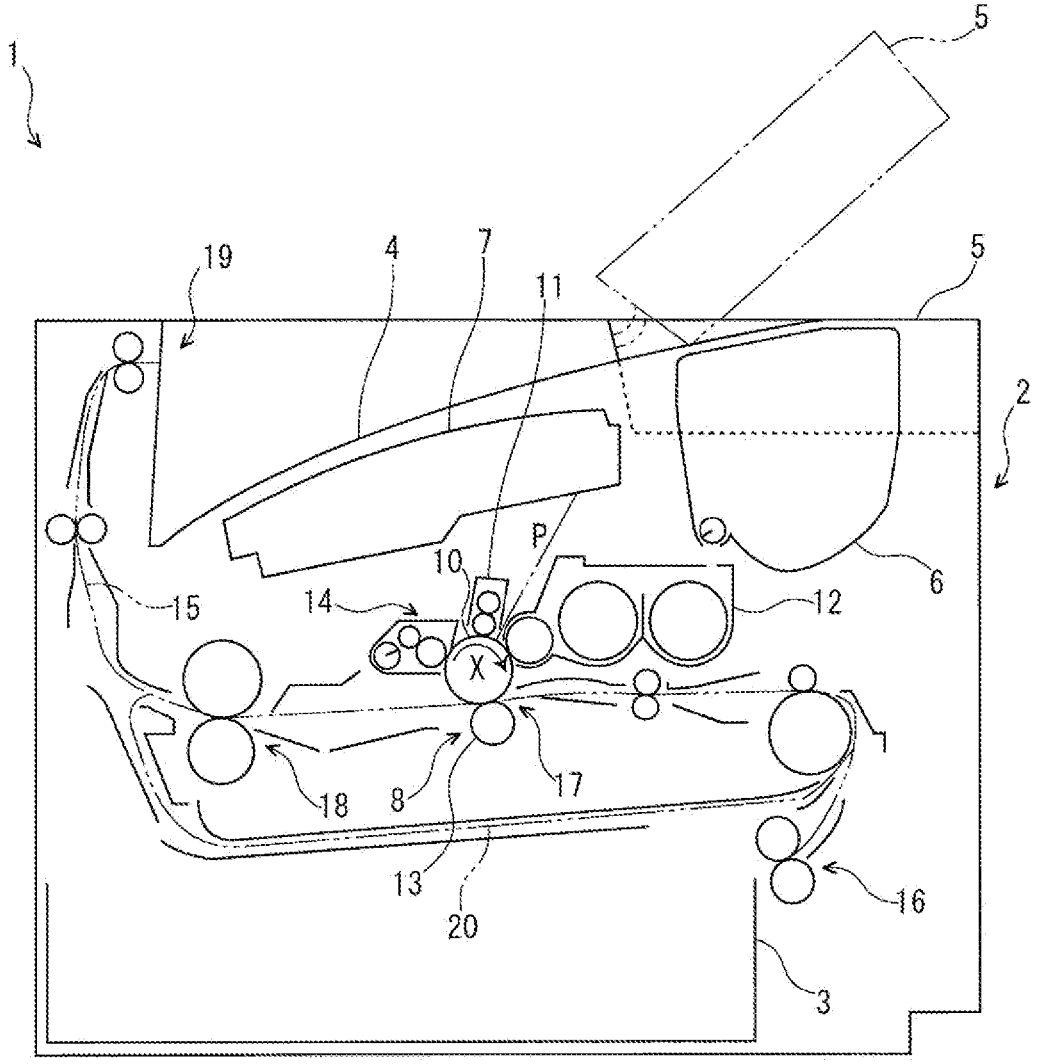
FIG. 1 is a schematic diagram schematically showing a printer according to an embodiment of the present disclosure.

First, with reference to FIG. 1, the entire structure of a printer 1 (an image forming apparatus) will be described.

The printer 1 includes a box-like formed printer main body 2. In a lower part of the printer main body 2, a sheet feeding cartridge 3 storing sheets (recording mediums) is installed and, in a top face of the printer main body 2, an ejected sheet tray 4 is formed. To the top face of the printer main body 2, an upper cover 5 is openably/closably attached at a lateral side of the ejected sheet tray 4 and, below the upper cover 5, a toner container 6 is installed.

In an upper part of the printer main body 2, an exposure device 7 composed of a laser scanning unit (LSU) is located below the ejected sheet tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are located along a rotating direction (refer to an arrow X in FIG. 1) of the photosensitive drum 10.

Inside the printer main body 2, a conveying path 15 for the sheet is arranged. At an upstream end in the conveying path 15, a sheet feeding part 16 is positioned. At an intermediate stream part in the conveying path 15, a transferring part 17 composed of the photosensitive drum 10 and transfer roller 13 is positioned. At a downstream part in the conveying path 15, a fixing device 18 is positioned. At a downstream end in the conveying path 15, a sheet ejecting part 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data is carried out to the photosensitive drum 10 by a laser light (refer to a two-dot chain line P in FIG. 1) from the exposure device 7, thereby forming an electrostatic latent image on the surface of the photosensitive drum 10. Subsequently, the development device 12 develops the electrostatic latent image to a toner image by a toner (a developer).

On the other hand, a sheet picked up from the sheet feeding cartridge 3 by the sheet feeding part 16 is conveyed to the transferring part 17 in a suitable timing for the above-mentioned image forming operation, and then, the toner image on the photosensitive drum 10 is transferred onto the sheet in the transferring part 17. The sheet with the transferred toner image is conveyed to a downstream side in the conveying path 15 to be inserted to the fixing device 18, and then, the toner image is fixed onto the sheet in the fixing device 18. The sheet with the fixed toner image is ejected from the sheet ejecting part 19 to the ejected sheet tray 4. The toner remained on the photosensitive drum 10 is collected by the cleaning device 14.

Next, the fixing device 18 will be described. Hereinafter, it will be described so that the front side of the fixing device 18 is positioned at the near side on FIG. 2, for convenience of explanation. An arrow Y in FIG. 2 indicates a conveying direction of the sheet (in the embodiment, left and right directions). An arrow Fr in each figure indicates the front side of the fixing device 18. An arrow I in each figure indicates the inside in forward and backward directions and an arrow O in each figure indicates the outside in forward and backward directions.

Figure 2:
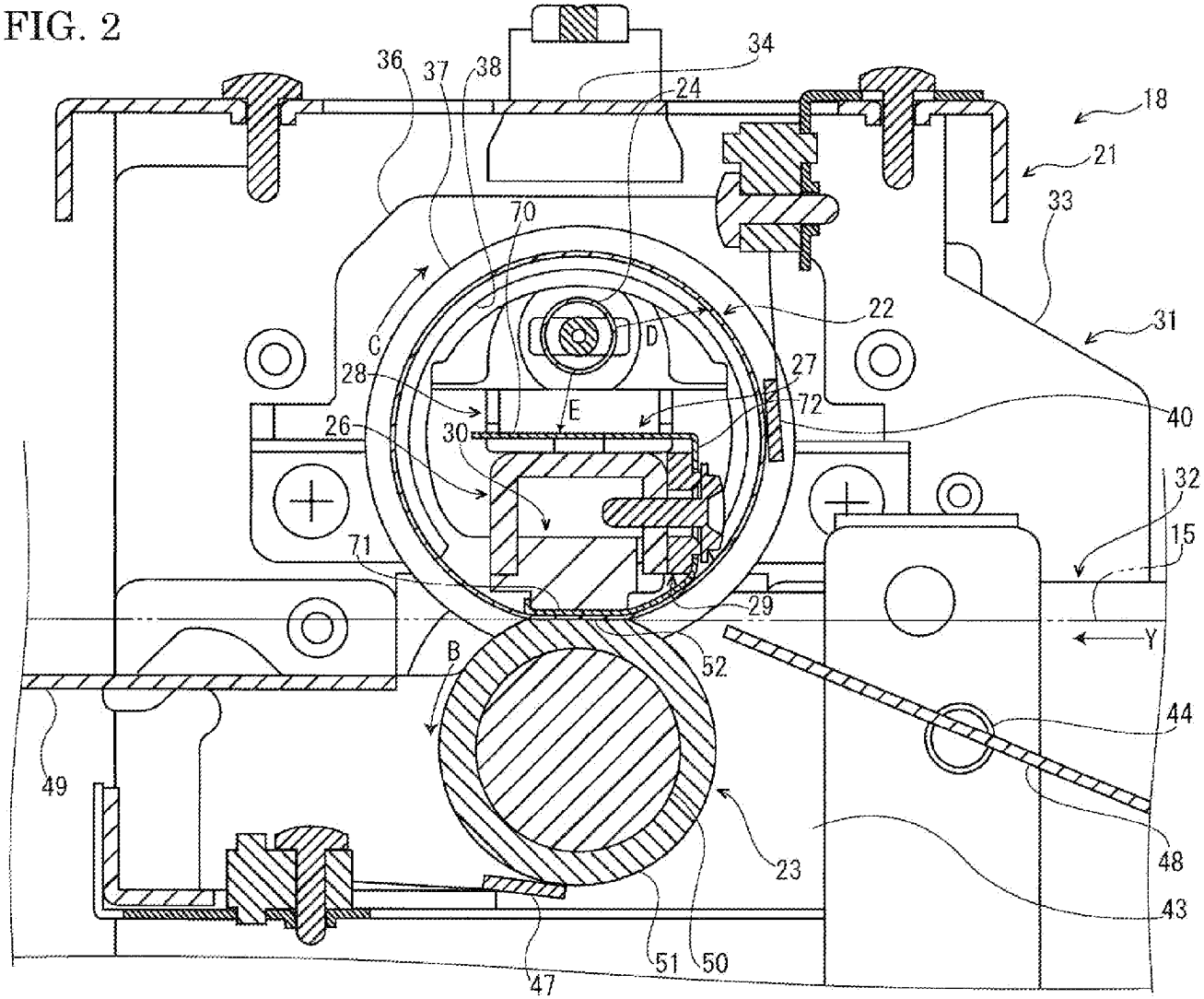
FIG. 2 is a sectional view showing a fixing device according to the embodiment of the present disclosure.

As shown in FIG. 2 and other figures, the fixing device 18 mainly includes a box-like formed fixing frame 21, a fixing belt 22, a pressuring roller 23 (a pressuring member), a heater 24 (a heat source), a supporting member 26, a nip member 27, a pair of spacers 28, three heat insulators 29 and a heat insulating member 30. The fixing belt 22 is installed in an upper part of the fixing frame 21. The pressuring roller 23 is installed in a lower part of the fixing frame 21. The heater 24 is arranged at the inside in a radial direction of the fixing belt 22. The supporting member 26 is arranged at the inside in the radial direction of the fixing belt 22 and at a lower side of the heater 24. The nip member 27 is arranged at the inside in the radial direction of the fixing belt 22 and at both upper and lower sides and a right side of the supporting member 26. The pair of spacers 28 is arranged at the upper side of the supporting member 26. The heat insulators 29 are arranged at the right side of the supporting member 26. The heat insulating member 30 is arranged at the lower side of the supporting member 26.

Figure 3:
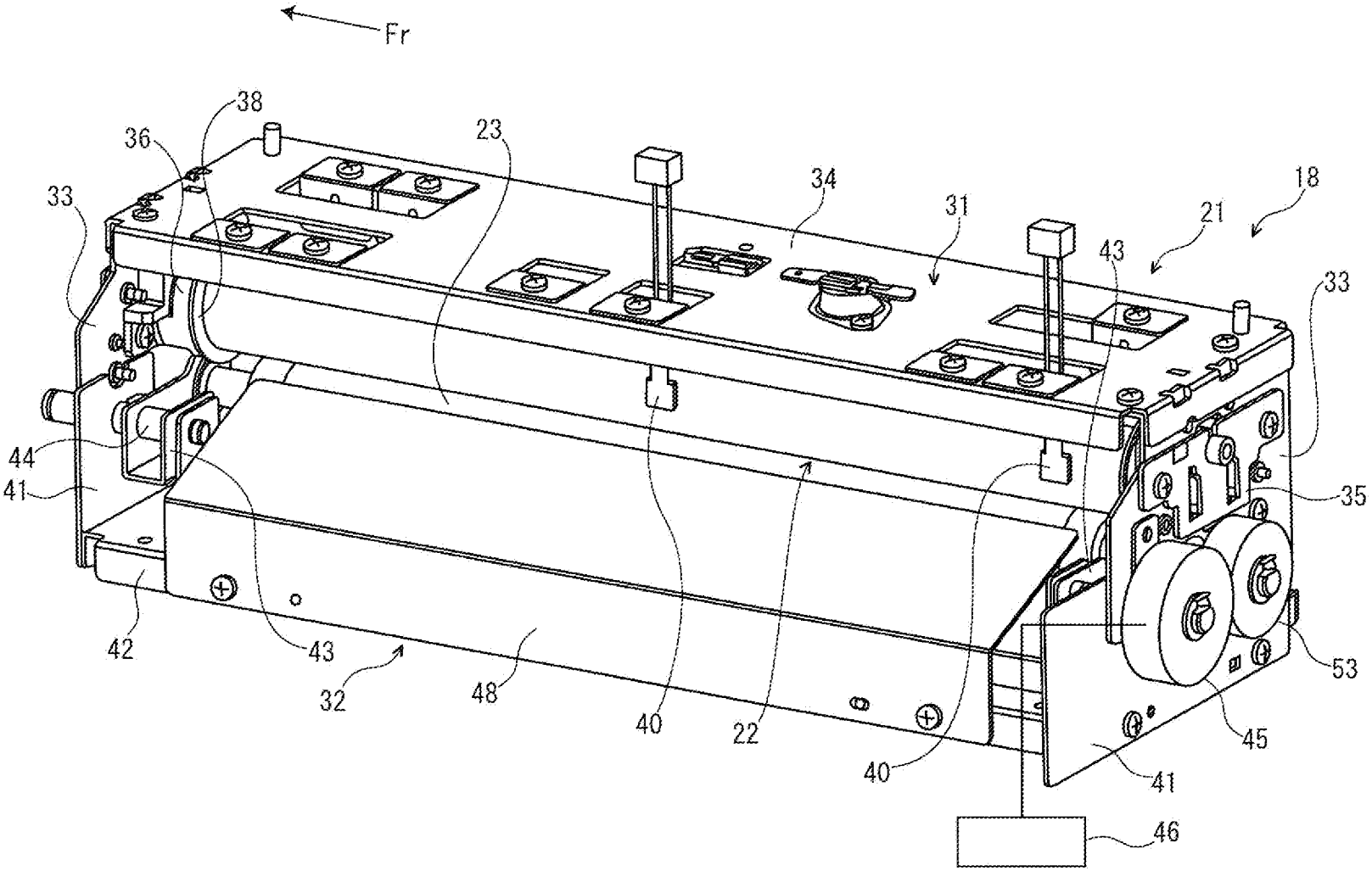
FIG. 3 is a perspective view showing the fixing device according to the embodiment of the present disclosure.

The fixing frame 21 is made of a plate metal. As shown in FIG. 3 and other figures, the fixing frame 21 is composed of an upper frame part 31 and a lower frame part 32 connected to each other.

The upper frame part 31 of the fixing frame 21 includes a pair of upper front and rear end plates 33 and a top plate 34 connecting upper end parts of the upper front and rear end plates 33.

Figure 4:
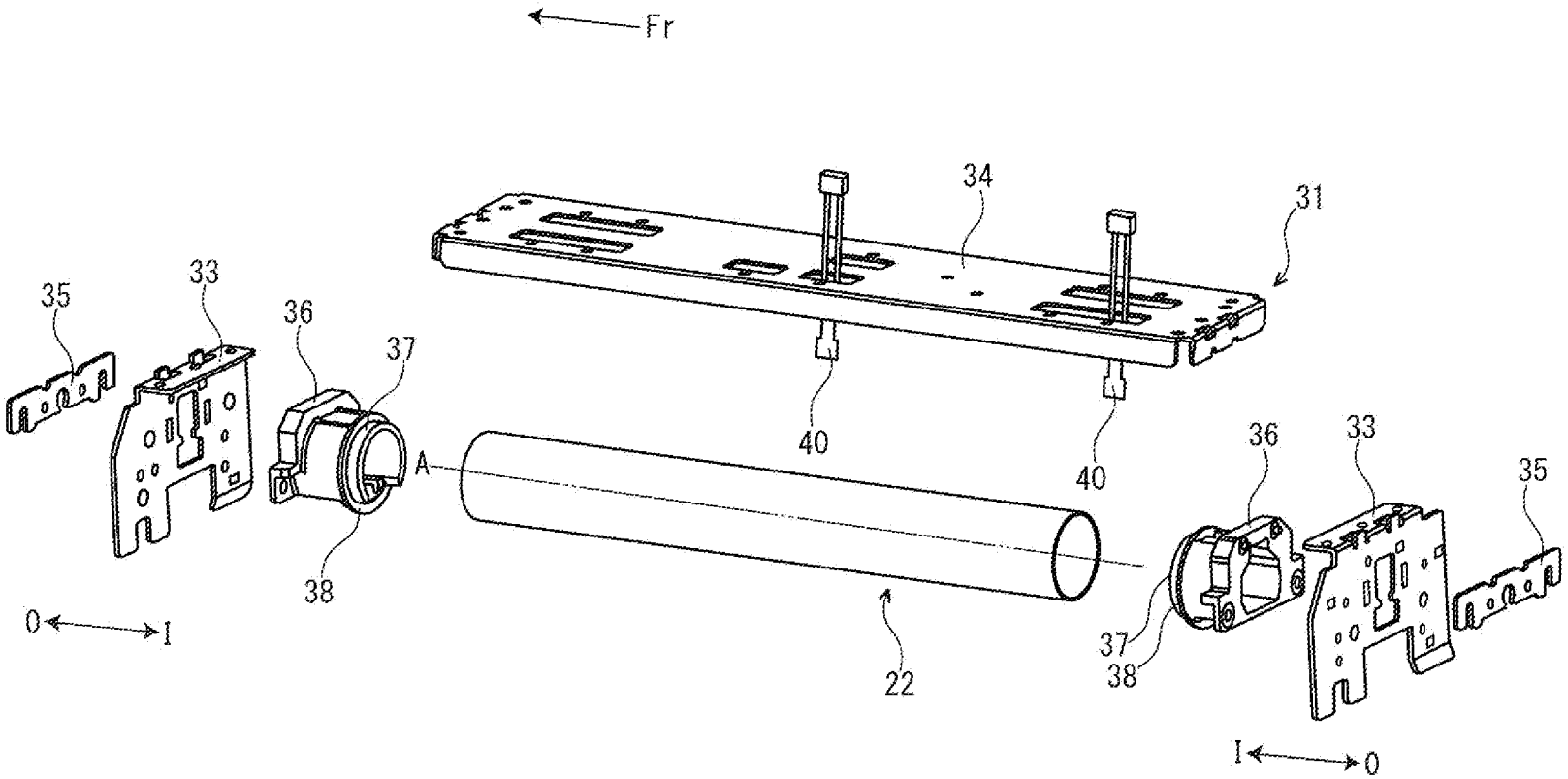
FIG. 4 is a perspective exploded view showing an upper frame part and a fixing belt in the fixing device according to the embodiment of the present disclosure.

As shown in FIG. 4 and other figures, to outer faces of the upper front and rear end plates 33 of the upper frame part 31, heater attachment plates 35 are fixedly attached. To inner faces of the upper front and rear end plates 33, belt attachment bases 36 are fixedly attached. In end parts at the inside in the forward and backward directions of the belt attachment bases 36, arc-like belt supporting parts 37 are formed. Around outer circumferences of the belt supporting parts 37, annular meandering restriction rings 38 are arranged.

To the top plate 34 of the upper frame part 31, a pair of first front and rear thermistors 40 are fixedly attached. As shown in FIG. 3 and other figures, the first front and rear thermistors 40 respectively come into contact with a center part and a rear part of an outer circumference face of the fixing belt 22.

The lower frame part 32 of the fixing frame 21 includes a pair of lower front and rear end plates 41 and a bottom plate 42 connecting lower end parts of the lower front and rear end plates 41.

To inner faces of the lower front and rear end plates 41 of the lower frame part 32, swing frames 43 are arranged. At right end parts of the swing frames 43, supporting shafts 44 are arranged so that each swing frame 43 swings around each supporting shaft 44 as a fulcrum. At a backward side (at the outside in the forward and backward directions) of the lower rear end plate 41, an input gear 45 is arranged coaxially with the supporting shafts 44. The input gear 45 is connected to a drive source 46 composed of a motor and others.

As shown in FIG. 2 and other figures, to the lower frame part 32, a second thermistor 47 is fixedly attached. The second thermistor 47 comes into contact with an outer circumference face of the pressuring roller 23. In the lower frame part 32, an approach guide 48 and an ejection guide 49 are arranged.

The fixing belt 22 is formed in a cylindrical shape elongated in the forward and backward directions. The fixing belt 22 has flexibility and is formed in an endless shape in a circumferential direction. The fixing belt 22 is composed of, for example, a base material layer, and a release layer covering the base material layer. The base material layer of the fixing belt 22 is made of, for example, metal, such as steel special use stainless (SUS). Incidentally, the base material layer of the fixing belt 22 may be made of resin, such as polyimide (PI). The release layer of the fixing belt 22 is made of, for example, perfluoro alkoxy alkane (PFA) tube. Each figure shows the respective layers (the base material layer and the release layer) of the fixing belt 22 without distinguishing.

Into both front and rear end parts of the fixing belt 22, the belt supporting parts 37 (refer to FIG. 4 and other figures) formed in the belt attachment bases 36 of the upper frame part 31 are inserted. Thereby, the fixing belt 22 is rotatably supported by the upper frame part 31. The fixing belt 22 can rotate around a rotation axis A (refer to FIG. 4) extending in the forward and backward directions. That is, in the embodiment, the forward and backward directions equal to a rotation axis direction of the fixing belt 22. Both front and rear end faces of the fixing belt 22 are arranged at the inside in the forward and backward directions of the meandering restriction rings 38 arranged in the belt attachment bases 36 of the upper frame part 31. Thereby, meandering (movement to the outside in the forward and backward directions) of the fixing belt 22 is restricted.

The pressuring roller 23 (refer to FIG. 2 and other figures) is formed in a columnar shape elongated in the forward and backward directions. The pressuring roller 23 is composed of, for example, a columnar core material 50, an elastic layer 51 provided around the core material 50 and a release layer (not shown) covering the elastic layer 51. The core material 50 of the pressuring roller 23 is made of, e.g. metal, such as iron. The elastic layer 51 of the pressuring roller 23 is made of, for example, silicone rubber. The release layer (not shown) of the pressuring roller 23 is made of, for example, PFA tube.

The pressuring roller 23 is arranged at a lower side (the outside) of the fixing belt 22. The pressuring roller 23 comes into pressure contact with the fixing belt and, between the fixing belt 22 and the pressuring roller 23, a fixing nip 52 is formed. The pressuring roller 23 is rotatably supported by center parts in a longitudinal direction (in the embodiment, center parts in the left and right directions) of the swing frames 43 so that the swing frames 43 are swung around the supporting shafts 44 to elevate and lower the pressuring roller 23 and to switch pressure of the fixing nip 52.

As shown in FIG. 3, in a rear end part of the pressuring roller 23, a drive gear 53 is fixedly attached. The drive gear 53 is meshed with the input gear 45 and connected to the drive source 46 via the input gear 45.

Figure 5:
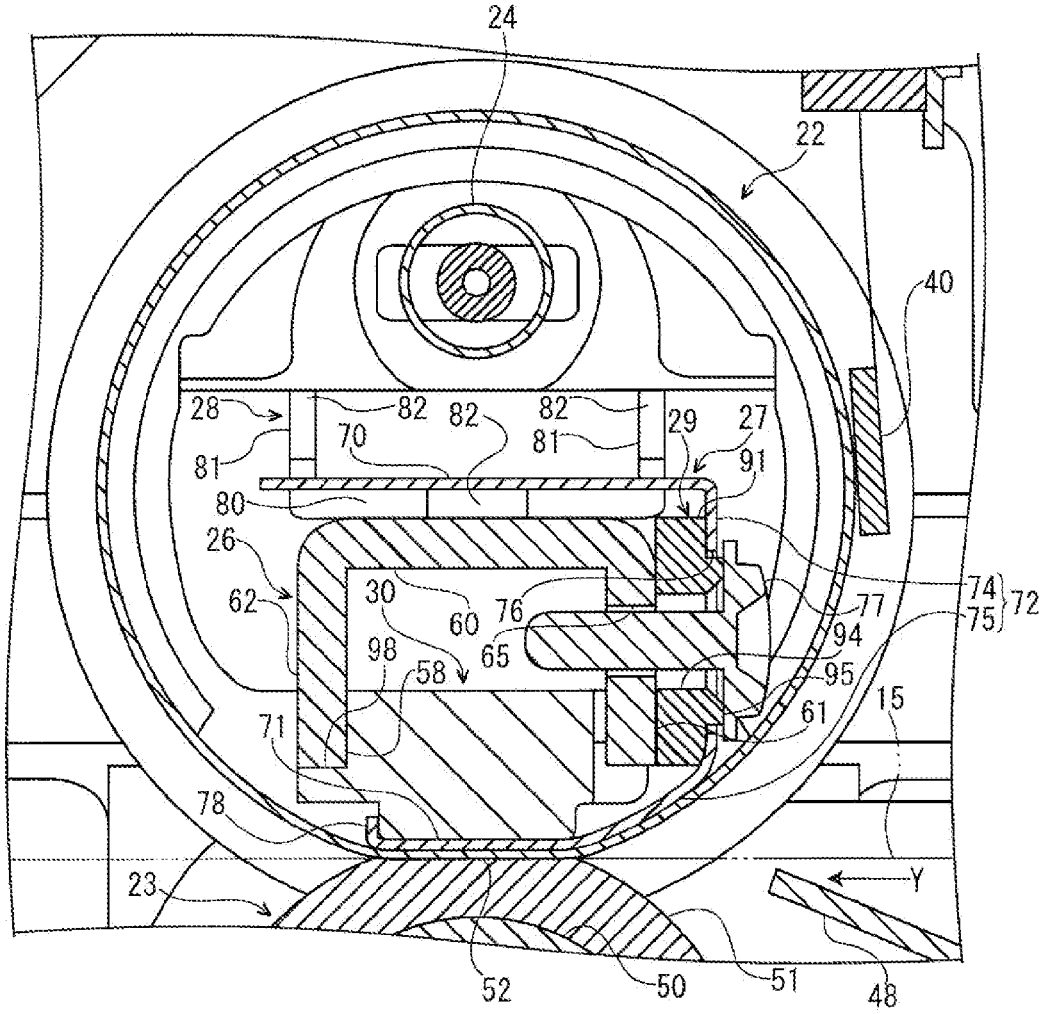
FIG. 5 is a sectional view showing the fixing belt and its periphery in the fixing device according to the embodiment of the present disclosure.
Figure 6:
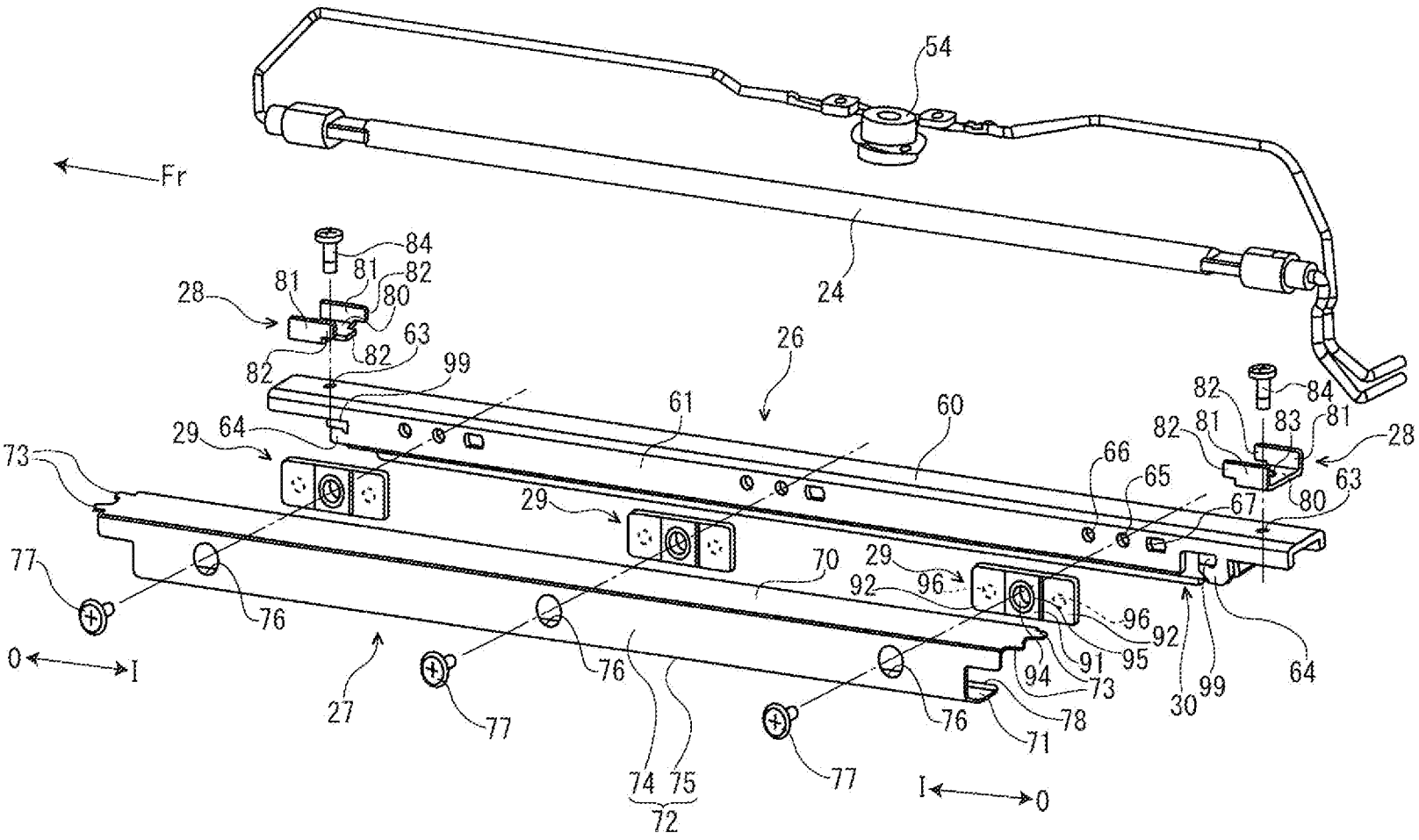
FIG. 6 is a perspective exploded view showing members arranged at the inside in a radial direction of the fixing belt in the fixing device according to the embodiment of the present disclosure.

The heater 24 (refer to FIGS. 5 and 6 and other figures) is composed of, for example, a halogen heater. The heater 24 is configured so as to generate heat by supplying current and to radiate a radiant heat. Both front and rear end parts of the heater 24 are connected to a thermostat 54. Both the front and rear end parts of the heater 24 are attached to the heater attachment plates 35 (refer to FIG. 4 and other figures) of the upper frame part 31 of the fixing frame 21.

The supporting member 26 (refer to FIGS. 5 and 6 and other figures) is formed in an elongated shape in the forward and backward directions. The supporting member 26 is formed, for example, by bending one plate metal, such as a material (galvanized steel plate) of SECC in JIS (Japanese Industrial Standard).

The supporting member 26 has an upper plate 60 extending along the left and right directions (a sheet conveying direction, i.e. a recording medium conveying direction), a first lateral plate 61 bent from a right end part of the upper plate 60 to a lower side and a second lateral plate 62 bent from a left end part of the upper plate 60 to the lower side. The supporting member 26 is formed in an inversed U-shape. In the supporting member 26, an opening part 58 is formed so as to open to the lower side (to a side of the fixing nip 52).

In both front and rear end parts of the upper plate 60 of the supporting member 26, fixed holes 63 are formed. In both front and rear end parts of the first lateral plate 61 of the supporting member 26, hook parts 64 are formed. In a center part and both front and rear side parts of the first lateral plate 61 of the supporting member 26, screw holes 65 are formed. At the forward sides of the screw holes 65, perfect circular first fitted holes 66 are formed. At the backward sides of the screw holes 65, elongated hole-like second fitted holes 67 are formed.

The nip member 27 (refer to FIGS. 5 and 6 and other figures) is formed in an elongated shape in the forward and backward directions. The nip member 27 is formed, for example, by bending and curving one plate metal made of metal with high thermal conductivity, such as aluminum or SUS.

The nip member 27 has a radiated part 70, a nip part 71, a connecting part 72 and a guide part 78 in a body. The nip part 71 is arranged at the lower side (at the side of the fixing nip 52) of the radiated part 70. The connecting part 72 connects a right end part (an end part at an upstream side, i.e. an upstream end part, in the sheet conveying direction) of the radiated part 70 and a right end part (an end part at the upstream side, i.e. an upstream end part, in the sheet conveying direction) of the nip part 71. The guide part 78 is bent from a left end part (an end part at a downstream side in the sheet conveying direction) of the nip part 71 to an upper side.

The radiated part 70 of the nip member 27 is extended along the left and right directions (in the sheet conveying direction). The radiated part 70 is arranged so as to cover the upper side of the supporting member 26. The radiated part 70 is arranged so as to partition the heater 24 from the supporting member 26. In both front and rear edge parts of the radiated part 70, a pair of left and right protruding pieces 73 are formed so as to protrude to the outside in the forward and backward directions.

The nip part 71 of the nip member 27 is extended along the left and right directions (in the sheet conveying direction). The nip part 71 is arranged at the lower side of the supporting member 26. The nip part 71 is arranged so as to sandwich a lower part (a part at the side of the fixing nip 52) of the fixing belt 22 between the nip part 71 and the pressuring roller 23 and to come into contact with an inner circumference face of the lower part of the fixing belt 22.

The connecting part 72 of the nip member 27 is arranged so as to cover the right side of the supporting member 26. The connecting part 72 has a fixed part 74 and a contact part 75 arranged at a lower side of the fixed part 74. At a center part in the forward and backward directions and both front and rear side parts of the fixed part 74, hole parts 76 are formed. The contact part 75 is curved along an inner circumference face of the fixing belt 22. The contact part 75 comes into contact with the inner circumference face of the fixing belt 22 at the upstream side of the fixing nip 52 in a rotating direction of the fixing belt 22.

Figure 7:
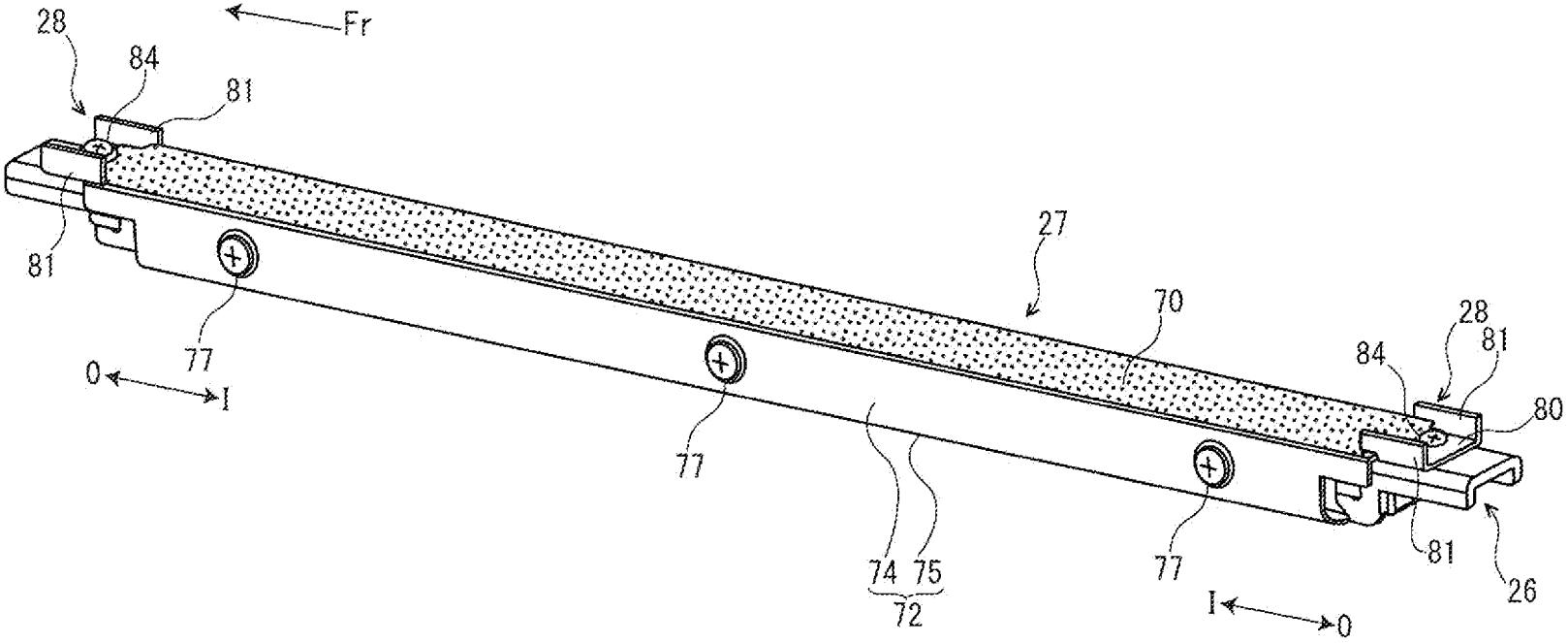
FIG. 7 is a perspective view showing a nip member and its periphery, as viewed from a right backward side, in the fixing device according to the embodiment of the present disclosure.

In FIG. 7, an area specified by spotted pattern indicates an area (in the embodiment, an upper face of the radiated part 70) in the nip member 27 which the radiant heat from the heater 24 reaches directly. Onto this area, black coating improving heat absorptivity (a temperature rise property) is applied.

Figure 8:
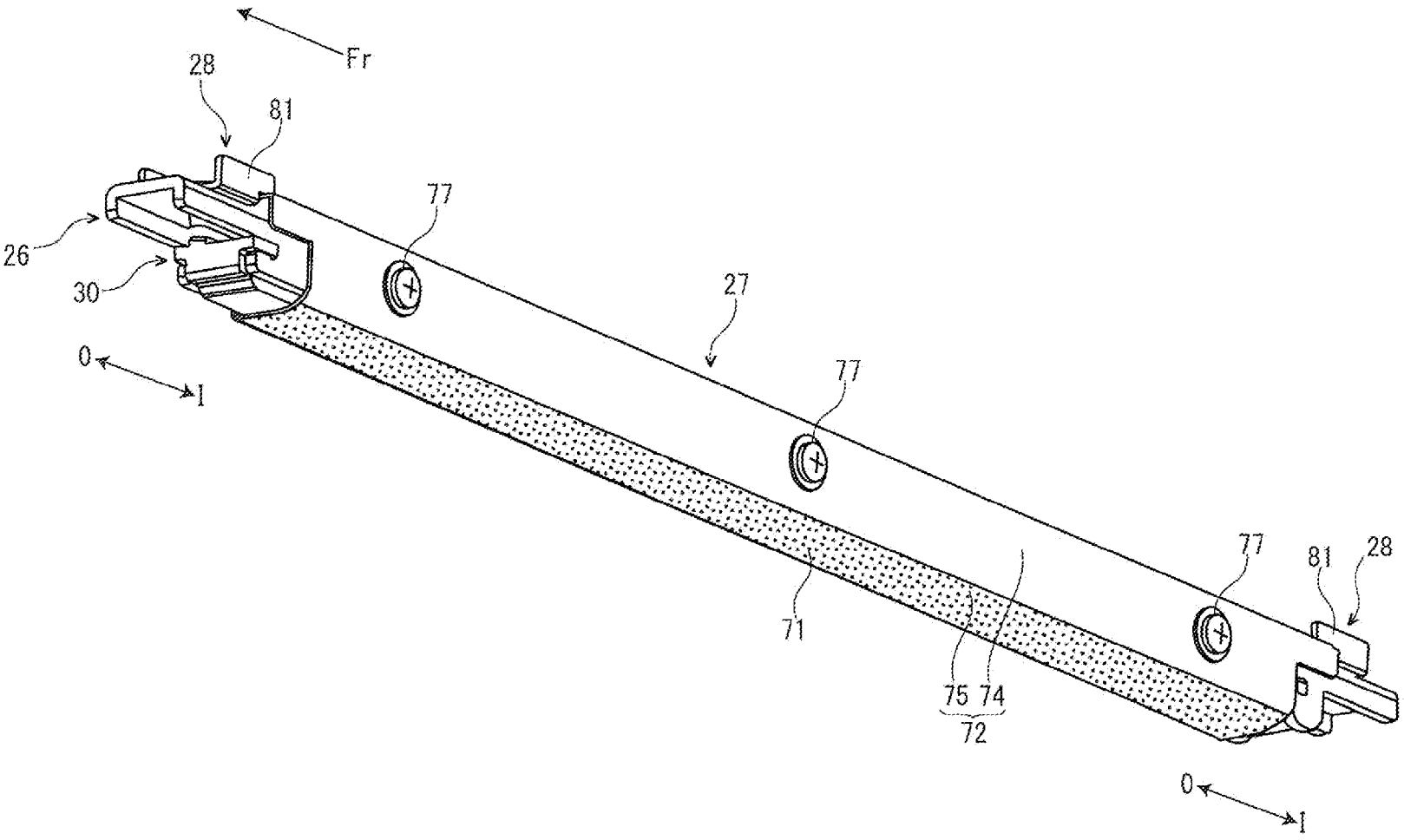
FIG. 8 is a perspective view showing the nip member and its periphery, as viewed from a right forward side, in the fixing device according to the embodiment of the present disclosure.

In FIG. 8, an area specified by spotted pattern indicates an area (in the embodiment, the nip part 71 and the contact part 75 of the connecting part 72) in the nip member 27 coming into contact with the inner circumference face of the fixing belt 22. Onto this area, fluorine coating, ceramic coating or electroless nickel plating is applied. Thereby, slidability of the fixing belt 22 onto the nip member 27 is improved and wear of the nip member 27 is prevented.

The spacers 28 (refer to FIGS. 5 and 6 and other figures) are arranged at both front and rear end sides of the supporting member 26. Each spacer 28 is made of, for example, resin, such as liquid crystal polymer (LCP), polyphenylene sulfide (PPS) or polyether ether ketone (PEEK).

The spacers 28 have bottom wall parts 80 and pairs of lateral wall parts 81. Each pair of lateral wall parts 81 are bent from both left and right end parts of each bottom wall part 80 to the upper side. In edge parts at the inside in the forward and backward directions of each bottom wall part 80 and each pair of lateral wall parts 81, protruding parts 82 protruding to the inside in the forward and backward directions are formed.

In center parts of the bottom wall parts 80 of the spacers 28, circular fixed holes 83 are respectively formed. By fixing screws 84 penetrating the fixed holes 83 and fixed holes 63 of the upper plate 60 of the supporting member 26, the spacers 28 are fixedly attached to the upper plate 60 of the supporting member 26. Onto the bottom wall parts 80, front and rear end parts of the radiated part 70 of the nip member 27 are placed. In a configuration as described above, the bottom wall parts 80 are arranged between the upper plate 60 of the supporting member 26 and the radiated part 70 of the nip member 27.

The heat insulators 29 (refer to FIGS. 5 and 6 and other figures) are respectively arranged at the center in the forward and backward directions and both front and rear sides of the supporting member 26. Each heat insulator 29 is made of, for example, resin, such as liquid crystal polymer (LCP), polyphenylene sulfide (PPS) or polyether ether ketone (PEEK). Each heat insulator 29 is arranged between the first lateral plate 61 of the supporting member 26 and the fixed part 74 of the connecting part 72 of the nip member 27.

The heat insulators 29 have first heat insulating parts 91 and second heat insulating parts 92. The second heat insulating parts 92 are arranged at both front and rear sides of each first heat insulating part 91. Right faces of the first heat insulating parts 91 are projected from right faces of the second heat insulating parts 92.

In the first heat insulating parts 91, screw holes 94 are formed. By screws 77 penetrating the screw holes 94 and the screw holes 65 formed in the first lateral plate 61 of the supporting member 26, each heat insulator 29 is fixedly attached to the first lateral plate 61 of the supporting member 26. In the right faces of the first heat insulating parts 91, annular protrusions 95 are formed around the screw holes 94. The annular protrusions 95 are fitted into the hole parts 76 formed in the fixed part 74 of the connecting part 72 of the nip member 27.

In left faces of the second heat insulating parts 92, fitting protrusions 96 are formed. The fitting protrusions 96 of the second heat insulating parts 92 at the forward side are fitted into the first fitted holes 66 of the first lateral plate 61 of the supporting member 26. The fitting protrusions 96 of the second heat insulating parts 92 at the backward side are fitted into the second fitted holes 67 of the first lateral plate 61 of the supporting member 26.

The heat insulating member 30 (refer to FIGS. 5 and 6 and other figures) is formed in an elongated shape in the forward and backward directions. The heat insulating member 30 is made of, for example, heat resistant resin, such as liquid crystal polymer (LCP). The heat insulating member 30 is arranged between the first lateral plate 61 of the supporting member 26 and the nip part 71 of the nip member 27 and between the second lateral plate 62 of the supporting member 26 and the nip part 71. A lower face of the heat insulating member 30 presses the fixing belt 22 to the lower side (to a side of the pressuring roller 23) via the nip part 71 of the nip member 27. An upper part of the heat insulating member 30 is inserted into the opening part 58 formed in the supporting member 26.

In the heat insulating member 30, an engaged recessed part 98 is formed so as to spread over a left lateral face and an upper face. With the engaged recessed part 98, a distal end part (a lower end part) of the second lateral plate 62 of the supporting member 26 is engaged. In both front and rear end parts of a right lateral face of the heat insulating member 30, engaging protrusions 99 are formed. With the engaging protrusions 99, the hook parts 64 formed in the first lateral plate 61 of the supporting member 26 are engaged. By such a configuration, the heat insulating member 30 is supported by the supporting member 26.

As described above, in the embodiment, between the supporting member 26 and the nip member 27, the spacers 28, the heat insulators 29 and the heat insulating member 30 are arranged. Therefore, the nip member 27 is arranged in a non-contact state with the supporting member 26.

In the fixing device 18 configured as described above, in order to fix the toner image onto the sheet, the drive source 46 is driven. When the drive source 46 is thus driven, rotation of the drive source 46 is transmitted to the pressuring roller 23 via the input gear 45 and the drive gear 53 and the pressuring roller 23 is rotated as indicated by an arrow B in FIG. 2. When the pressuring roller 23 is thus rotated, the fixing belt 22 coming into pressure contact with the pressuring roller 23 is co-rotated in an opposite direction to the pressuring roller 23 as indicated by an arrow C in FIG. 2. When the fixing belt 22 is thus rotated, the fixing belt 22 is slid onto the nip member 27.

In addition, in order to fix the toner image onto the sheet, the heater 24 is operated (turned on). When the heater 24 is thus operated, the radiant heat is radiated from the heater 24. A part of the radiant heat radiated from the heater 24 reaches directly the inner circumference face of the fixing belt 22 as indicated by an arrow D in FIG. 2 and absorbed by the fixing belt 22. Another part of the radiant heat radiated from the heater 24 reaches directly the upper face of the radiated part 70 of the nip member 27 as indicated by an arrow E in FIG. 2 and absorbed by the radiated part 70 of the nip member 27. The radiant heat absorbed by the radiated part 70 of the nip member 27 is transmitted to the nip part 71 of the nip member 27 via the connecting part 72 of the nip member 27. According to this, temperature of the nip part 71 is risen and the fixing nip 52 is heated by heat transmission from the nip part 71.

In the embodiment, as described above, it is configured so that the radiant heat radiated from the heater 24 reaches directly the inner circumference face of the fixing belt 22 and the upper face of the radiated part 70 of the nip member 27. By applying such a configuration, since the heater 24 can heat directly the nip member 27, it is possible to heat the fixing nip 52 by heat transmission from the nip member 27. Therefore, even if the sheet takes heat of the fixing nip 52 while the sheet passes through the fixing nip 52, it is possible to restrain temperature of the fixing nip 52 from suddenly lowering and to surely fix the toner image onto the sheet.

The radiated part 70 of the nip member 27 is arranged so as to partition the heater 24 from the supporting member 26. By applying such a configuration, it is possible to prevent the radiant heat from the heater 24 from being radiated directly to the supporting member 26. According to this, it is possible to reduce heat taken by the supporting member 26, to improve the temperature rise property of the fixing belt 22 and to enhance energy saving performance of the fixing device 18.

Between the upper plate 60 of the supporting member 26 and the radiated part 70 of the nip member 27, the bottom wall parts 80 of the spaces 28 are arranged. By applying such a configuration, since heat transmission from the radiated part 70 of the nip member 27 to the supporting member 26 can be restrained, it is possible to further reduce heat taken by the supporting member 26.

The nip member 27 has the connecting part 72 connecting the right end part (the end part at the upstream side, i.e. the upstream end part, in the sheet conveying direction) of the radiated part 70 and the right end part (the end part at the upstream side, i.e. the upstream end part, in the sheet conveying direction) of the nip part 71. By applying such a configuration, even if the radiated part 70 and the nip part 71 are arranged at an interval, it is possible to surely transmit heat of the radiated part 70 to the nip part 71 via the connecting part 72.

Between the first lateral plate 61 of the supporting member 26 and the connecting part 72 of the nip member 27, the heat insulators 29 are arranged. By applying such a configuration, since heat transmission from the connecting part 72 of the nip member 27 to the supporting member 26 can be restrained, it is possible to further reduce heat taken by the supporting member 26.

The contact part 75 of the connecting part 72 of the nip member 27 comes into contact with the inner circumference face of the fixing belt 22 at the upstream side of the fixing nip 52 in the rotating direction of the fixing belt 22. By applying such a configuration, heat of the nip member 27 can be transmitted to the fixing belt 22 at the upstream side of the fixing nip 52 in the rotating direction of the fixing belt 22. Therefore, it is possible to further surely fix the toner image onto the sheet.

Between the nip part 71 of the nip member 27 and the first lateral plate 61 of the supporting member 26 and between the nip part 71 and the second lateral plate 62 of the supporting member 26, the insulating member 30 is arranged. By applying such a configuration, since heat transmission from the nip part 71 of the nip member 27 to the supporting member 26 can be restrained, it is possible to further reduce heat taken by the supporting member 26.

In the embodiment, a case where the connecting part 72 connects the right end part (the end part at the upstream side, i.e. the upstream end part, in the sheet conveying direction) of the radiated part 70 and the right end part (the end part at the upstream side, i.e. the upstream end part, in the sheet conveying direction) of the nip part 71 was described. On the other hand, in another embodiment, the connecting part 72 may connect a left end part (an end part at the downstream side in the sheet conveying direction) of the radiated part 70 and a left end part (an end part at the downstream side in the sheet conveying direction) of the nip part 71, or alternatively, the radiated part 70 and the nip part 71 may be connected without the connecting part 72.

In the embodiment, a case where the contact part 75 of the connecting part 72 of the nip member 27 comes into contact with the inner circumference face of the fixing belt 22 at the upstream side of the fixing nip 52 in the rotating direction of the fixing belt 22 was described. On the other hand, in another embodiment, the contact part 75 of the connecting part 72 of the nip member 27 may come into contact with the inner circumference face of the fixing belt 22 at the downstream side of the fixing nip 52 in the rotating direction of the fixing belt 22, or alternatively, the connecting part 72 of the nip member 27 may not come into contact with the inner circumference face of the fixing belt 22.

In the embodiment, a case where one heater 24 is arranged at the inside in the radial direction of the fixing belt 22 was described. On the other hand, in another embodiment, a plurality of heaters 24 may be arranged at the inside in the radial direction of the fixing belt 22.

Although, in the embodiment, a case of using the halogen heater as the heater 24 was described, in another embodiment, a ceramic heater or the like may be used as the heater 24.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt arranged rotatably;

a pressuring member arranged rotatably to come into pressure contact with the fixing belt so as to form a fixing nip;

a heat source arranged at the inside in a radial direction of the fixing belt to radiate a radiant heat; and a nip member arranged so as to sandwich the fixing belt between the nip member and the pressuring member, wherein the heat source, the fixing belt and the nip member are arranged so that the radiant heat radiated from the heat source reaches directly an inner circumference face of the fixing belt and the nip member, and the fixing device further comprising:

a supporting member supporting the nip member, wherein the nip member includes:

a radiated part which the radiant heat radiated from the heat source reaches directly; and a nip part connected to the radiated part, formed in a body with the radiated part and arranged so as to sandwich the fixing belt between the nip part and the pressuring member, the radiated part is arranged so as to partition the heat source from the supporting member.

2. The fixing device according to claim 1 further comprising:

a spacer arranged between the supporting member and the radiated part.

3. The fixing device according to claim 1, wherein the nip member further includes:

a connecting part connecting an upstream end part of the radiated part in a recording medium conveying direction and an upstream end part of the nip part in the recording medium conveying direction.

4. The fixing device according to claim 3 further comprising:

a heat insulator arranged between the supporting member and the connecting part.

5. The fixing device according to claim 3, wherein at least a part of the connecting part comes into contact with the inner circumference face of the fixing belt at the upstream side of the fixing nip in a rotating direction of the fixing belt.

6. The fixing device according to claim 1 further comprising:

a heat insulating member arranged between the nip part and the supporting member.

7. The fixing device according to claim 6, wherein the supporting member has an opening part formed so as to open to a side of the fixing nip, a part of the heat insulating member is inserted into the opening part.

8. The fixing device according to claim 1, wherein the nip member is arranged in non-contact state with the supporting member.

9. The fixing device according to claim 1, wherein the nip member has an area which the radiant heat from the heat source reaches directly and coating improving heat absorptivity is applied to the area.

10. An image forming apparatus comprising:

the fixing device according to claim 1.

* * * * *